US005310289A

United States Patent [19]

Hess

[11] Patent Number: 5,310,289

[45] Date of Patent: May 10, 1994

[54] APPARATUS FOR SHEETING DEEP TRENCHES

[76] Inventor: Wilhelm Hess, Siegstrasse 1, D-50859 Köln, Fed. Rep. of Germany

[21] Appl. No.: 88,703

[22] Filed: Jul. 8, 1993

[30] Foreign Application Priority Data

Sep. 15, 1992 [DE] Fed. Rep. of Germany ..... 4230860

[51] Int. Cl.[5] ..... E21D 5/12

[52] U.S. Cl. ..... 405/282; 405/272; 405/283

[58] Field of Search ..... 405/282, 283, 272, 273

[56] References Cited

U.S. PATENT DOCUMENTS

| | | | |
|---|---|---|---|
| 2,908,140 | 10/1959 | Everson | 405/283 |
| 3,910,053 | 10/1975 | Krings | 405/282 |
| 4,145,891 | 3/1979 | Krings | 405/283 X |
| 4,376,599 | 3/1983 | Krings | 405/282 |
| 4,657,442 | 4/1987 | Krings | 405/282 |

FOREIGN PATENT DOCUMENTS

| | | | |
|---|---|---|---|
| 0039960 | 11/1981 | European Pat. Off. | 405/283 |
| 8400572 | 2/1984 | World Int. Prop. O. | 405/283 |

*Primary Examiner*—Dennis L. Taylor
*Attorney, Agent, or Firm*—Egli International

[57] ABSTRACT

An apparatus for sheeting a deep trench, including pairs of vertical support rails arranged along the trench so that the support rails of each pair of support rails are opposite each other at an equal distance, the support rails having guide channels, a rigid strut frame holding the support rails of a pair of rails at a distance from each other and being formlockingly displaceable on the support rails, and large-surfaced outer sheeting plates and inner sheeting plates having vertical edges that are vertically displaceable in the guide channels of the support rails, the support rails having two side walls spaced from each other which, together with an outer wall and an inner wall, form an at least partially closed box beam, and the guide channels being formed, at least partially, on outer sides of the side walls by guide flanges, which lay in the plane of the outer wall, and support flanges which are spaced from the guide flanges, the side walls of the support rails being extended inward past the inner wall, the support flanges being provided on projecting end portions of the side walls, a vertical guide channel being provided between the support flanges and projecting portions of the side walls, which vertical guide channel formlockingly encompasses a rail located at a respected end of the strut frame, the strut frame being provided on opposite sides of the rail with rollers rotatably supported on a horizontal axle and adapted to roll on outer sides of the support flanges.

11 Claims, 6 Drawing Sheets

APPARATUS FOR SHEETING DEEP TRENCHES

BACKGROUND OF THE INVENTION

The invention relates to an apparatus for sheeting deep trenches, and includes pairs of vertical support rails arranged along a trench. The support rails of each pair of support rails being arranged at the same distance opposite each other. A rigid strut frame holds support rails of a pair of rails at a distance from each other and is form-lockingly displaceable on the support rails. The apparatus also has large-surface outer sheeting plates and inner sheeting plates the vertical edges of which are vertically displaceable in guide channels of the support rails. The support rails have two side walls spaced from each other which, together with an outer wall and an inner wall, form an at least partially closed box beam, and the guide channels are formed, at least partially, by outer sides of the side walls, guide flanges, which lay in the plane of the outer wall, and support flanges which are spaced from guide flanges.

Such an apparatus is disclosed in German publication DE 40 28 832 A1. In the known apparatus, the inner wall of the support rail adjacent to the trench, which is formed as a box beam, is arranged on the longitudinal edge of the support rail adjacent to the trench. This inner wall extends up to the outer ends of support flanges which are bent out of the side wall. At the side edges, this inner wall has a bent-out C-shaped portion which forms a relatively wide guide rail for vertical rails secured to the strut frame. The relatively large width of the guide rails for the strut frame makes it more difficult to insert the strut frame in the guide rails formed by the C-shaped portions. Furthermore, because the inner wall extends up to the outer ends of the support flanges, it is unnecessarily heavy.

SUMMARY OF THE INVENTION

Accordingly, it is an object of the present invention to provide a sheeting apparatus of the above-mentioned type in which the material expenditure is reduced, while maintaining the same degree of loading capacity, and the insertion of the strut frame into the vertical rails is made easier.

Pursuant to this object and others which will become apparent hereafter, one aspect of the present invention resides in extending the side walls of the support rails inwardly past the inner wall, with the support channels provided on the projecting end portions of the side walls, and by providing a vertical guide channel between the support flanges and projecting portions of the side walls, which vertical guide channel formlockingly encompasses a rail located at a respective end of the strut frame, the strut frame being provided on opposite sides of the rail with rollers rotatably supported on a horizontal axle and adapted to roll on outer sides of the support flanges.

Because the vertical guide rails of the strut frame are displaceable between the side walls of the support rail, insertion of the strut frame in the vertical guide channels is facilitated. Because the inner wall extends only between side walls, expenditure of a material is noticeably reduced. Furthermore, providing rollers on both side of the vertical rails of the strut frame facilitates both insertion of the strut frame between the support rails and its smooth movement thereon.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
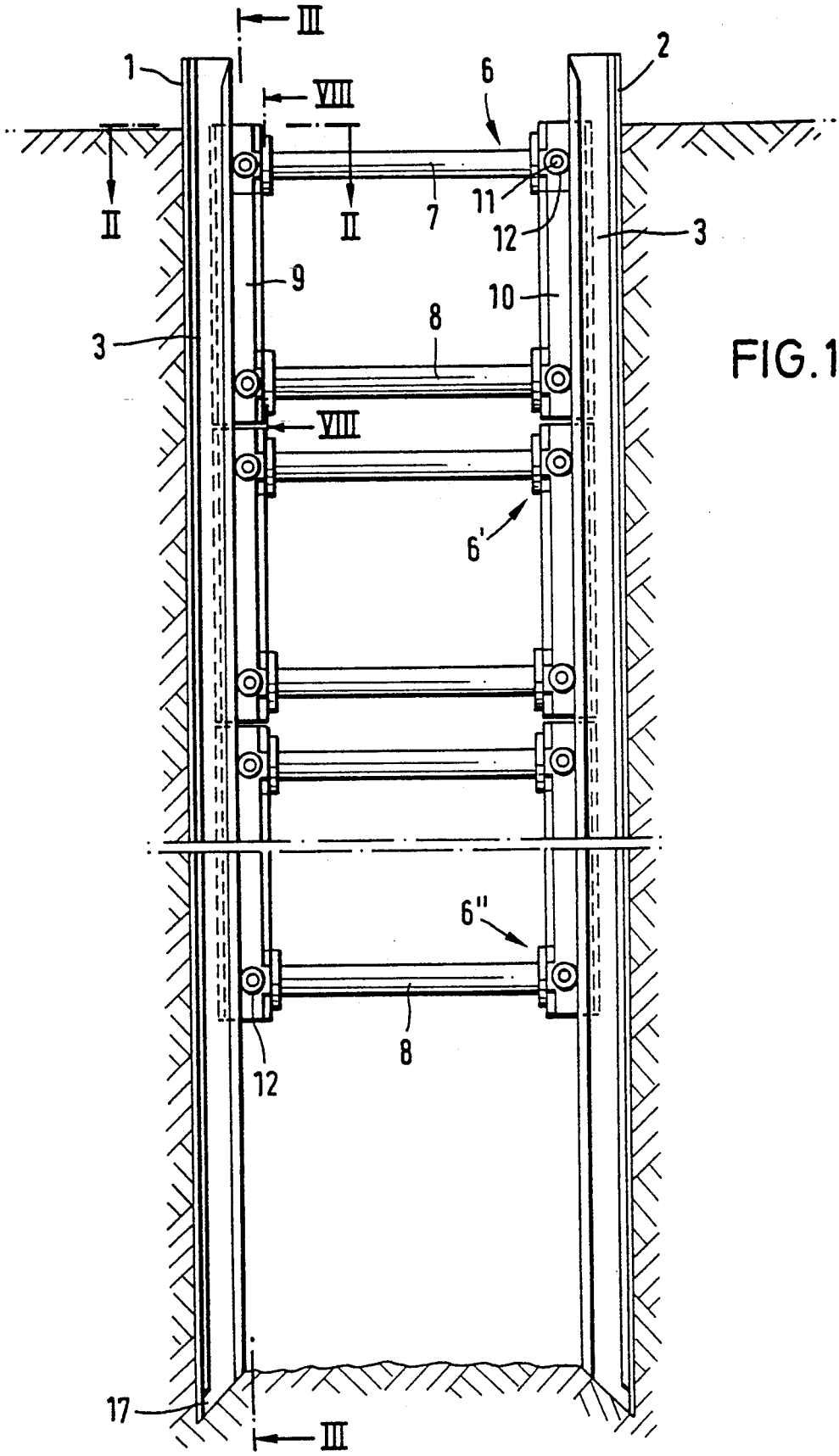
FIG. 1 shows a view of a support frame with a strut frame inserted in the support rails.

FIG. 1 shows an apparatus for sheeting trenches over 6 m deep. The apparatus has a plurality of support frames arranged in the longitudinal direction of a trench at the same distance from each other. Each support frame includes two parallel support rails 1 and 2 and at least one strut frame 6 arranged therebetween. The strut frame 6 keeps the support rails 1, 2 at a predetermined distance from each other and simultaneously connects them to form a support frame. FIG. 1 shows three strut frames 6, 6' and 6'' arranged between the support rails 1, 2. Each support rail 1, 2 is provided with guide channels 3 in which large-surface sheeting plates are vertically displaceable.

Figure 2:
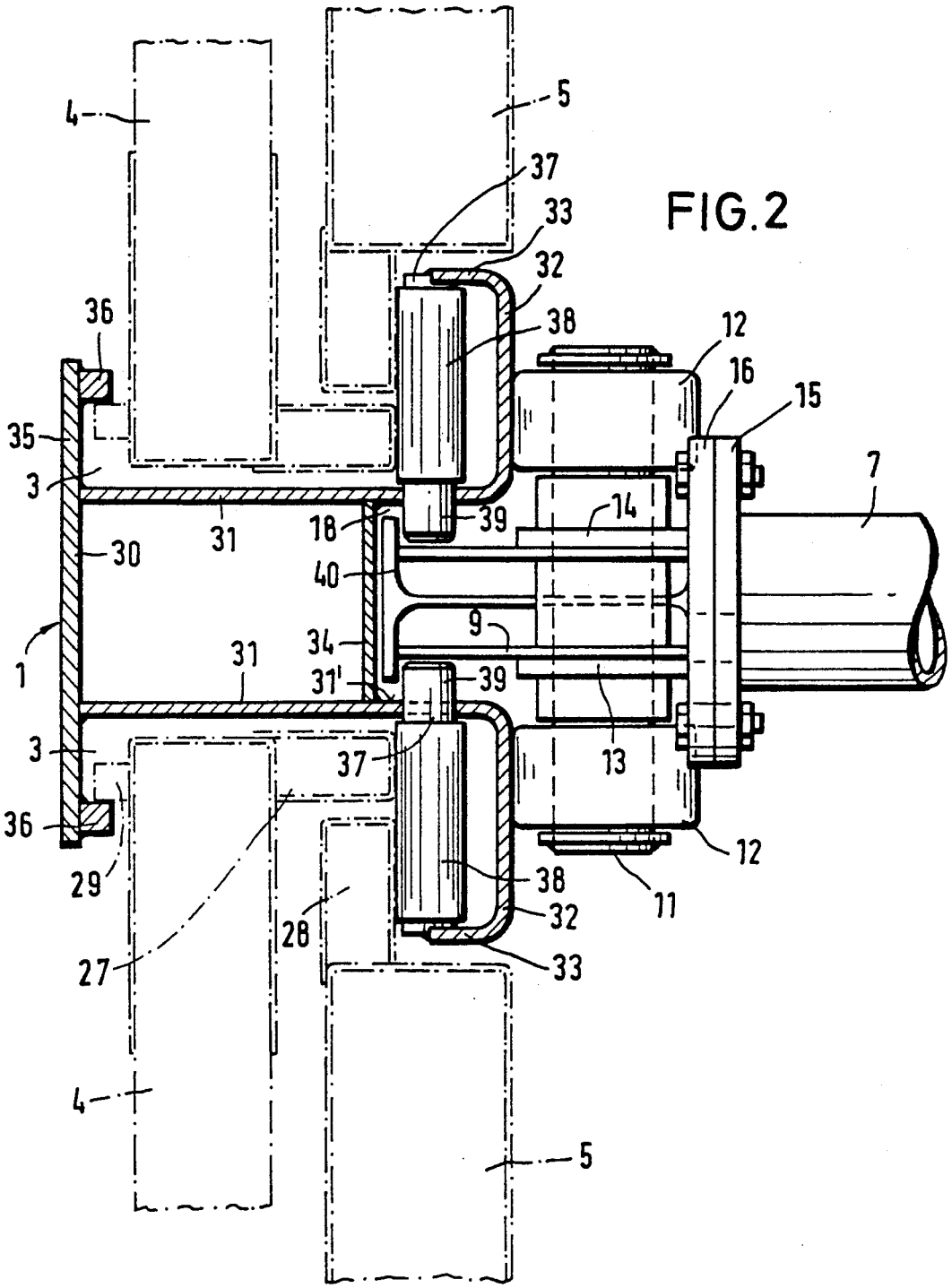
FIG. 2 shows a cross-sectional view along line II—II in FIG. 1.

As shown in FIG. 2, an outer sheeting plate 4 and an inner sheeting plate 5 are displaceable in the guide channels 3. However, a support rail can be provided with two, three and even more separated guide channels in which large-surface sheeting plates can be vertically displaceable independent of each other.

In the embodiment of the sheeting apparatus shown in FIG. 2, both sides of a support rail 1 or 2 are provided not with two guide channels but one guide channel 3 formed by support flanges 32 and guide flanges 35. In this guide channel 3, both the outer sheeting plate 4 and the inner sheeting plate 5 are displaceable. Both sheeting plates 4, 5 are supported on the support flange 32 by support stays 27, 28. The sheeting plates 4, 5 also have different shapes. The outer sheeting plates 4 are somewhat wider and have a relatively high stay 27. The edges of the outer sheeting plates 4 are displaceable in the guide channel 3 in the longitudinal direction of a trench over guide beads 29, 36, which they formlockingly engage. The inner sheeting plates 5 are supported on support flanges 32 by flat stays 28. A side flange 33 is bent out of the support flange 32 so that between the side flange 33 and a side wall 31 of the support rails 1, 2 support rollers 38 can be arranged in a row one above the other, and on which the support stays 27, 28 of the sheeting plates 4 and 5 are displaceable.

The support rollers 38 are rotatable about axles 37. The outer ends of the axles 37 are welded to the end faces of the side flanges 33, and the inner ends of the axles 37 are supported in the side walls 31 of the support rails 1 or 2. Projecting ends 39 of the axles 37 form, in the space between the side walls 31, axle journals which engage behind a vertical rail 40 of the strut frame 6. A vertical channel 18 is formed between the inner wall 34 of the support rail 1 or 2 and the axle journals 39. The vertical guide channel 18 formlockingly receives the guide rail 40 arranged on both sides of the strut frame 6 so that, upon insertion of the strut frame 6 between the support rails 1, 2, a steadfast support frame is formed.

Figure 6:
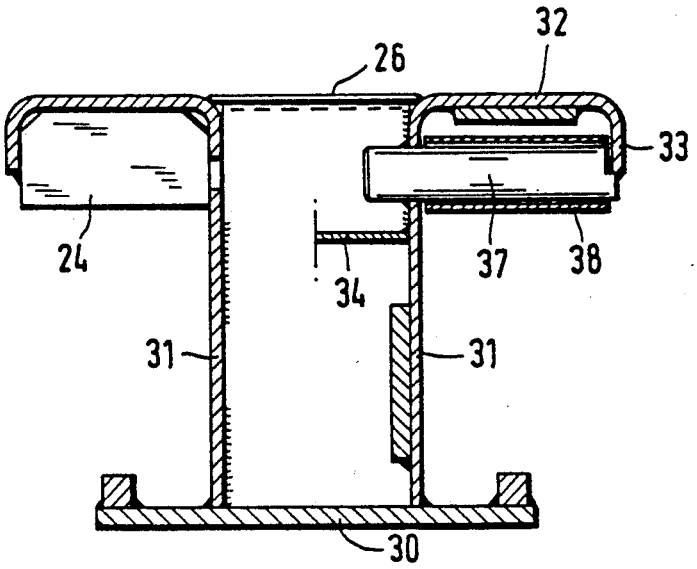
FIG. 6 shows a cross-sectional view along line VI—VI in FIG. 3.
Figure 5:
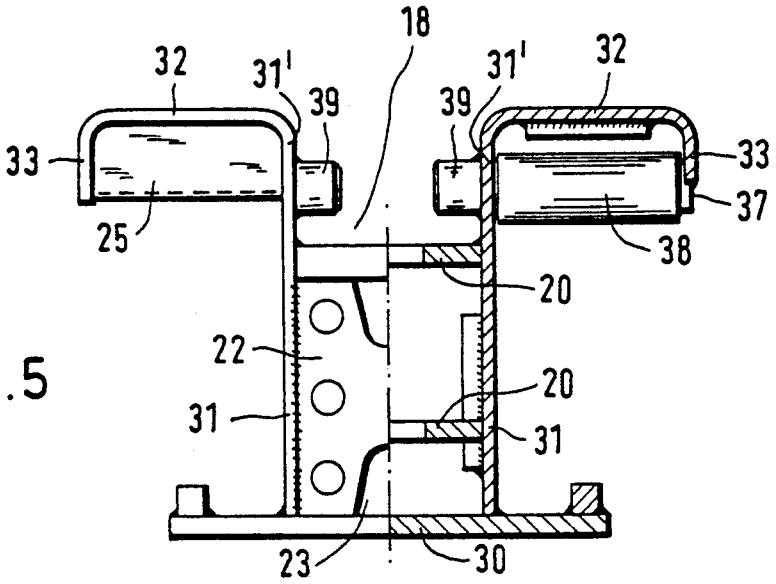
FIG. 5 shows a cross-sectional view along line V—V in FIG. 3.
Figure 7:
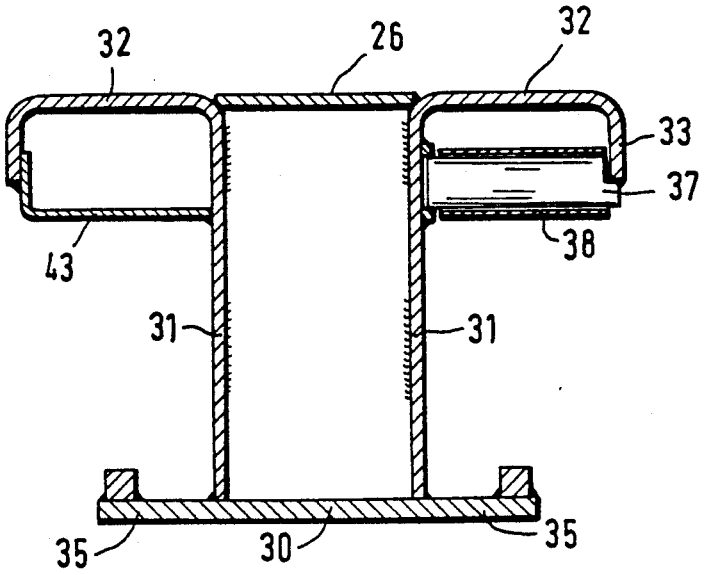
FIG. 7 shows a cross-sectional view along line VII—VII in FIG. 3.
Figure 8:
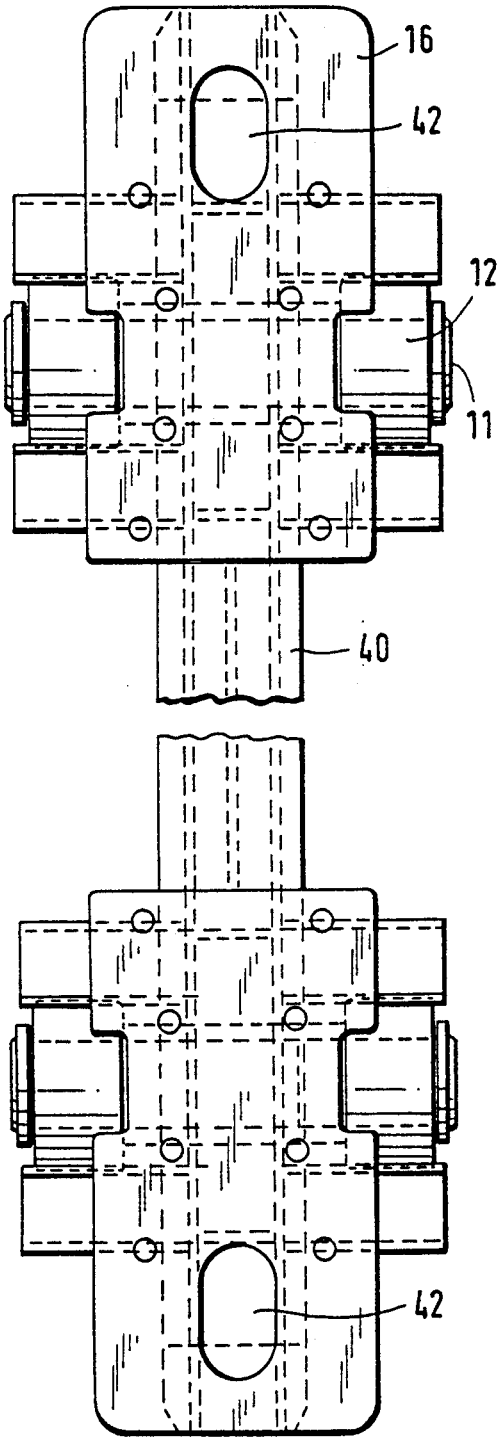
FIG. 8 shows a plan view of a vertical strut of the strut frame viewed in the direction of arrow VIII in FIG. 1.
Figure 9:
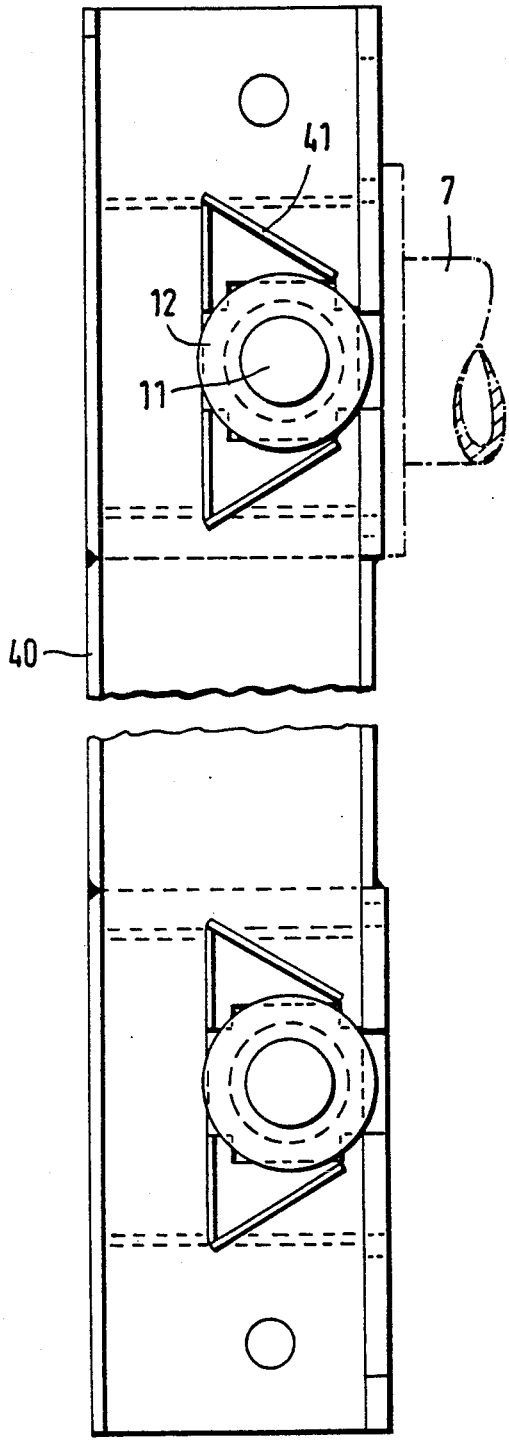
FIG. 9 shows a side view of the vertical strut shown in FIG. 8.

As shown in FIGS. 5 and 6, horizontal strut walls 24, 25 are welded between the outer sides of side walls 31 of the support rail 1 and 2 and inner sides of the side flanges 33, so that the support flanges 32 are able to absorb forces applied by rollers 12 of the strut frames 6, 6' and 6''. Each strut frame 6, 6' and 6'' is formed of upper 7 and lower 8 cross-struts and left 9 and right 10 vertical struts. Both cross-struts 7, 8 are provided at their ends with screw-down plates 15 extending at right angles to longitudinal axes of the cross-struts 7, 8, respectively. Corresponding screw-down plates 16 are arranged at upper and lower ends of the vertical struts 9, 10, so that the cross-struts 7, 8 and the vertical struts 9, 10, so that the cross-struts 7, 8 and the vertical struts 9, 10 can be connected to form a stable frame. The axles II with the rollers 12 are located on the vertical struts 9, 10 at the height of the cross-struts 7, 8.

As shown in FIG. 2, the vertical strut 9 of the strut frame 6 is formed as a box beam with rails 40 projecting sidewise past the side wall of the box beam forming the vertical strut 9. The cross-struts 7, 8 can be longitudinally adjustable, which requires that the left and right vertical struts always extend parallel to each other.

Figure 3:
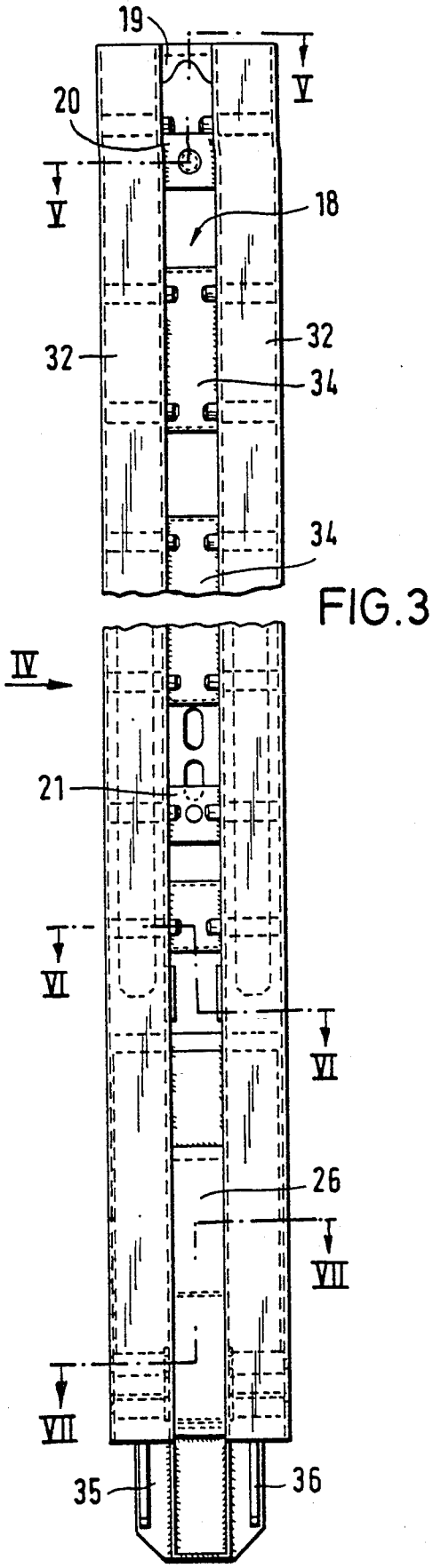
FIG. 3 shows a cross-sectional view along line III—111 in FIG. 1.
Figure 4:
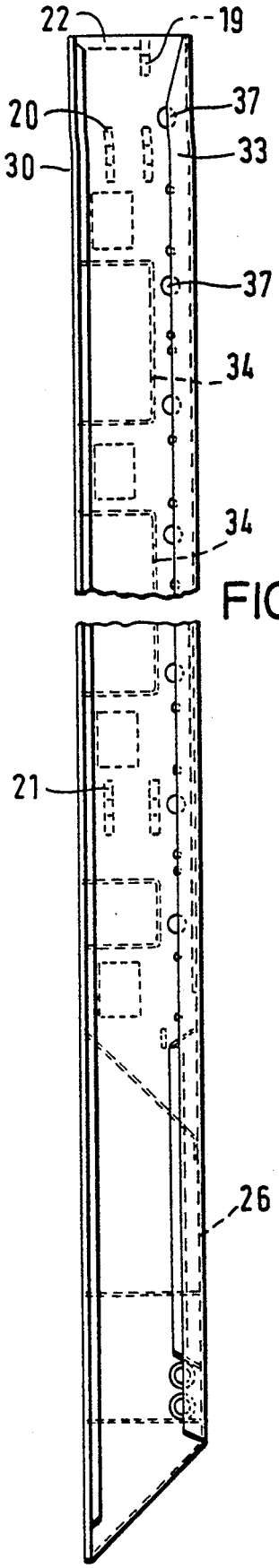
FIG. 4 shows a side view of a support rail shown in FIG. 3.

As shown in FIGS. 3 and 4, the vertical channel 18 extends only in the upper portion of the support rail over 4/6 to 5/6 of the total height. In the lower region of the support rail, which extends only 2/6 to 1/6 of the total height, there is provided, between the side walls 31 in the plane of the support flange 32, and inner locking wall 26. Smooth locking of the support rails 1 and 2 has the advantage that no concrete flows into the support rails when pouring mixed-in situ concrete.

The rollers 12 on both sides of the vertical strut 9 or 10 of the strut frame 6 are spaced from each other a distance that is greater than the distance between support stays of the outer sheeting plate 4 displaceable in the support rail 1 or 2. The greater distance between the rollers 12 has the advantage that no movement will be transmitted from the outer sheeting plates 4 which would cause rotation of the support rails.

In order to prevent displacing rollers 12 from carrying earth or dirt into their roll tacks on the support flanges 32, they are covered with guard plates 41. The plates 41 can be arranged so that they remove earth lumps clinging to the displacing rollers 12.

The support rails 1, 2 are provided at their upper ends with connection flanges 22 which, a shown in FIG. 5, have centering openings 23 to facilitate connection of a lengthening support rail so that its guide channels for the sheeting plates 4, 5 are aligned with those of the support rails 1, 2 of the strut frame. For attaching frame hooks of the like, tooth crests 19 are arranged at the upper ends of the support rails in the plane of the inner wall 34 forming a part of the guide channel 18 for the rail 40. For transporting or moving the support rails 1, 2 brackets **20*a* are welded between the side walls 31 for receiving bolts. The brackets 20 are also arranged in the planes of the inner walls 40 and likewise form a part of the guide channel 18. For welding other bolts or stops for the strut frames 6, 6' and 6'', brackets 21, which are provided with appropriate openings and corresponding to brackets 20, are welded in the lower portion of the support rails 1, 2**.

Figure 10:
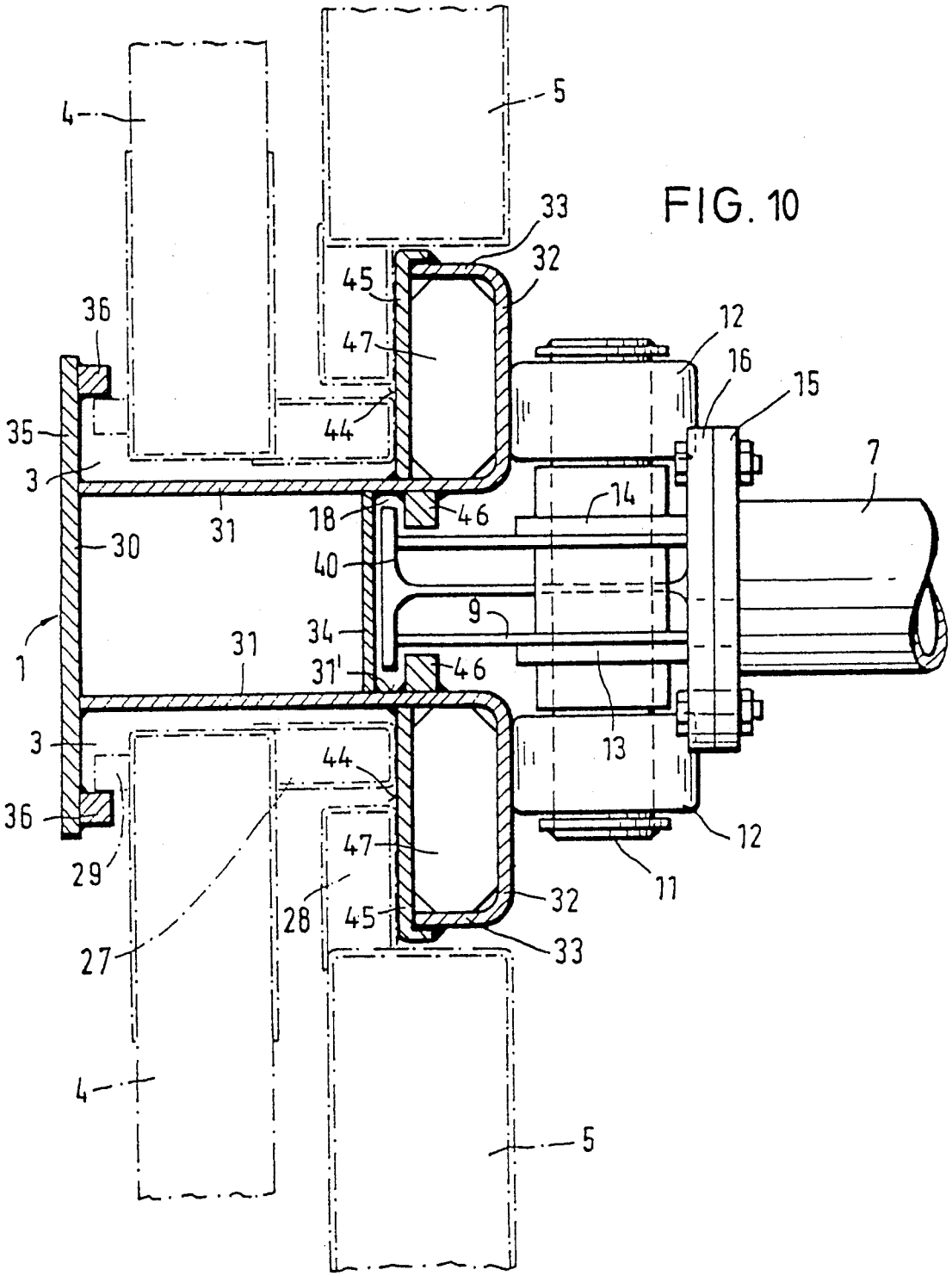
FIG. 10 is a view similar to FIG. 2 of a simplified embodiment of the invention.

FIG. 10 shows a simplified construction of the rail 1 or 2 in a view along the line II—II in FIG. 1. In this construction, the outer sheeting plates 4 and the inner sheeting plates 5 are guided in the vertical direction on slide surfaces 44 that are provided as cover plates 45 which are welded to the outer sides of the side walls 31 and the side flanges 33.

Instead of the axle journals 39 of FIG. 2, the embodiment of FIG. 10 utilizes steel bars 46 that are welded to the side wall 31 so as to be spaced from and parallel to the inner wall 34. The steel bars 46 together with the inner wall 34 of the rails 1 or 2 form the channel 18 that on both sides of the strut frame 6 takes in the vertical rail 40 in a form-closed manner.

Support plates 47 are welded into the box-shaped hollow section formed by the side wall 31, the support flange 32, the side flange 33 and the cover plates 45. The support plates 47 reinforce the support flanges 32 in the horizontal direction so as to take up the forces exerted by the rollers 12 of the strut frames 6, 6', 6''.

While the invention has been illustrated and described in an arrangement for sheeting deep trenches, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An apparatus for sheeting a deep trench, comprising:

pairs of vertical support rails arranged along the trench so that the support rails of each pair of support rails are opposite each other at an equal distance, the support rails having guide channels, a rigid strut frame holding the support rails of a pair of rails at a distance from each other and being formlockingly displaceable on the support rails; and large-surfaced outer sheeting plates and inner sheeting plates having vertical edges that are vertically displaceable in the guide channels of the support rails, the support rails having two side walls spaced from each other which, together with an outer wall and an inner wall, form an at least partially closed box beam, and the guide channels being formed, at least partially, on outer sides of the side walls by guide flanges, which lay in the plane of the outer wall, and support flanges which are spaced from the guide flanges;

the side walls of the support rails being extended inward past the inner wall, the support flanges being provided on projecting end portions of the side walls, a vertical guide channel being provided between the support flanges and projecting portions of the side walls, which vertical guide channel formlockingly encompasses a rail located at a respected end of the strut frame, the strut frame being provided on opposite sides of the rail with rollers rotatably supported on a horizontal axle and adapted to roll on outer sides of the support flanges.

2. An apparatus according to claim 1, wherein the support flanges have free ends from which side flanges are bent out, and further comprising horizontal axles, on which digging plates are supported, that are secured in the projecting portions of the side walls and on the side flanges so that axle journals project into space between the two side walls and form the inner guide of the guide channel.

3. An apparatus according to claim 2, and further comprising rollers rotatably supported on the horizontal axles.

4. An apparatus according to claim 2, wherein horizontal strut walls are welded between outer sides of the side walls of the support rails an inner sides of the side flanges.

5. An apparatus according to claim 1, wherein the guide channel is arranged only in an upper portion of the support rail which extends over 4/6–5/6 of the total height, and, in a lower portion of the support rail, which extends over 2/6–1/6 of total height, an inner locking wall is provided in a space between the side walls.

6. An apparatus according to claim 1, wherein the strut frame is formed of an upper cross-strut, a lower cross-strut, a right vertical strut and a left vertical strut, wherein the both cross-struts are provided at their ends, with screw-down plates extending at a right angle to longitudinal axes of the cross-struts and screwed to further screw-down plates provided at upper and lower ends of the vertical struts parallel to the longitudinal axes thereof.

7. An apparatus according to claim 6, wherein stubs with rolls are provided on the vertical struts at the height of the cross-struts.

8. An apparatus according to claim 6, wherein the cross-struts are longitudinally adjustable.

9. An apparatus according to claim 1, wherein the rollers are covered from above and beneath with guard plates to prevent soiling of the rollers.

10. An apparatus according to claim 1, wherein the support rails are provided with flanges at their upper ends for connection with another support rail, the connection flanges being provided with screw openings and a centering opening in which a centering peg of the connectable support rail is engageable.

11. An apparatus according to claim 1, wherein cover plates are fastened to outer sides of the side walls and side flanges, said cover plates having outer side surfaces on which the sheeting plates are guidable, steel bars being fastened to the side walls so as to be spaced from and parallel to the inner wall to form the channel for the rail.

* * * * *